US005720697A

United States Patent [19]

Winkel

[11] Patent Number: 5,720,697

[45] Date of Patent: Feb. 24, 1998

[54] PARALLEL BARS

[76] Inventor: Ted Winkel, 4814 Rte. 269, Castalia, Ohio 44824

[21] Appl. No.: 286,689

[22] Filed: Aug. 5, 1994

[51] Int. Cl.[6] ..... A63B 1/00; A63B 3/00

[52] U.S. Cl. ..... 482/41; 482/42; 434/255

[58] Field of Search ..... 482/41, 42, 68, 482/69, 908; 434/255

[56] References Cited

U.S. PATENT DOCUMENTS

| | | | |
|---|---|---|---|
| 2,690,789 | 10/1954 | Zadrozny | 482/42 |
| 2,788,971 | 4/1957 | Berne | 272/63 |
| 2,812,010 | 11/1957 | Abdallah | 482/69 |
| 3,207,511 | 9/1965 | Hoffman | 482/42 |
| 3,697,066 | 10/1972 | Wieland | 272/63 |
| 4,902,000 | 2/1990 | Starks et al. | 482/41 |
| 4,988,092 | 1/1991 | Trout | 434/255 |
| 5,024,601 | 6/1991 | Barker | 434/255 |
| 5,147,262 | 9/1992 | Hymanson | 482/908 |

*Primary Examiner*—Stephen R. Crow
*Attorney, Agent, or Firm*—Jerry Semer

[57] ABSTRACT

The invention comprises of two sets of parallel bars that are placed on top of each other. The first set of parallel bars is designed to fit under an individual's arm pits who is walking the parallel bars. The second set of parallel bars is set at a height where the individual's hands can grab the parallel bars for walking along the parallel bars. Both sets of parallel bars are individually adjustable to fit all the sizes of the individual who may use the device.

12 Claims, 6 Drawing Sheets

PARALLEL BARS

FIELD OF THE INVENTION

This invention relates to parallel bars and more particularity to such a device that is intended for use in the field of physical therapy for the purposes of rehabilitation of disabled persons.

BACKGROUND OF THE INVENTION

Parallel bars have been used for many years for walking exercises for disabled individuals. They are mainly used for individuals whose leg's strength is not sufficient for them to walk unaided. Usually an individual places his hands upon the parallel bars and then walks between them using his arm's strength to compensate for the poor leg strength. One of the problems with these devices occurs when an individual does not have sufficient arm and leg strength to actually fully walk the parallel bars. If the individuals arm strength gives out he immediately falls to the ground unless another individual comes to his aid. Therefore, one of the objectives of this invention is to create a parallel bar system designed so that when an individual loses his arm's strength he still stays upright on the parallel bars and will not fall. This not only helps the disable person but also means that there is less necessity of supervision on the bars. Further, the mere fact that he will not fall if he loses his strength will give the individual walking the bar much more confidence and allow them to make greater gain on the training. Also, it is an objection of the invention to create a parallel bar system such that an individual who does not have sufficient arm and leg strength to walk a regular set of parallel bars would be able to walk this newly invented set of parallel bars. This will enable another class of individuals whose strength is not sufficient for parallel bars now in use to use the inventor's parallel bar system.

The feature that the inventor has created to meet these objectives is another set of bars that fit under the individual's arm pit. Thus, if an individual loses his strength in his arms and legs the top bar will still hold him up by his arm pits. This of course gives the individual the advantage that if he loses his strength during walking he will not fall. Also, it gives the advantage to individuals who do not have sufficient strength to walk normal parallel bars that they could walk this set of parallel bars. In addition, it gives added confidence to the individual walking the parallel bars in that he knows that he will not fall.

SUMMARY OF THE INVENTION

The invention comprises of two sets of parallel bars that are placed on top of each other. The first set of parallel bars is designed to fit under an individual's arm pits whose is walking the parallel bars. The second set of parallel bars is set at a height where the individual's hands can grab the parallel bars for walking along the parallel bars. Both sets of parallel bars are individually adjustable to fit all the sizes of the individual who may use the device.

DETAILED DESCRIPTION OF THE PREFERRED EMBODIMENT

Figure 1A:
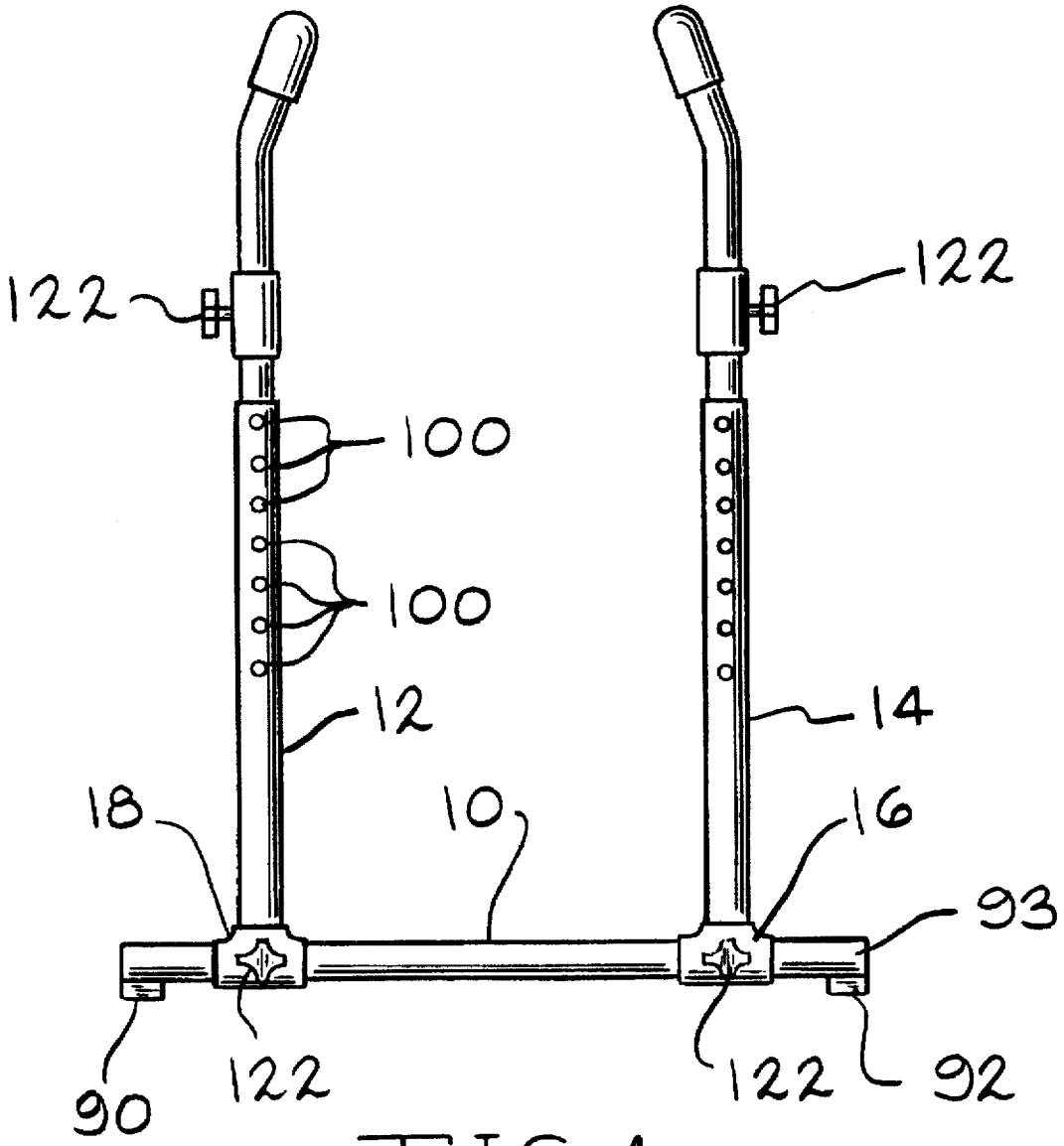
FIG. 1*a* is an end view of one end of the invention.
Figure 1B:
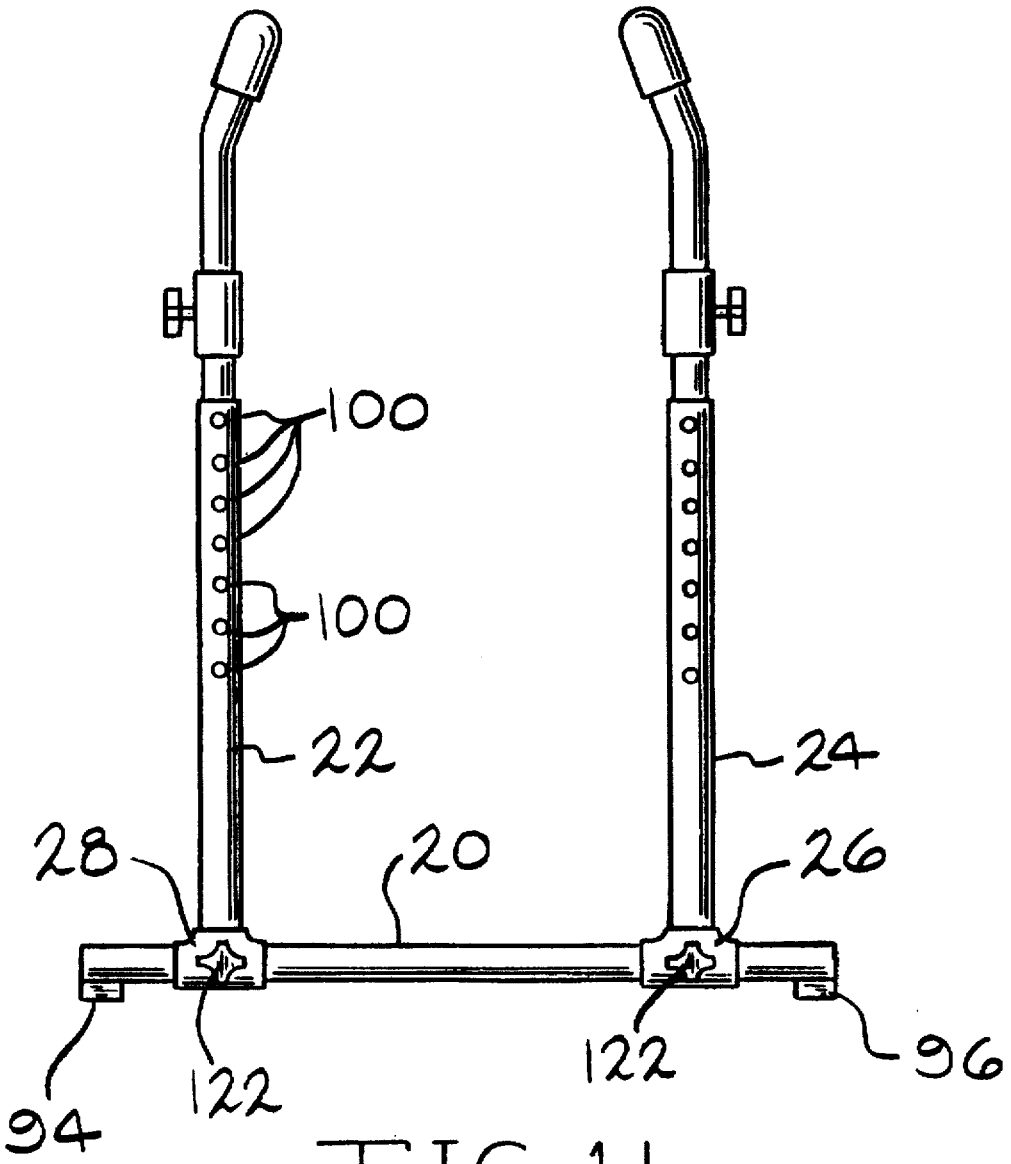
FIG. 1*b* is an end view of the other end of the invention.

FIG. 1*a* is a end view of the invention. It shows base 10 that comprises a rod 93 of sufficient length and width that is able to hold the two vertical posts 12 and 14 in upright position. In the preferred embodiment this base has a rectangular cross section. At the end of base 10 are two feet 90 and 92. These feet 90 and 92 are of sufficient size to hold the invention in place. For the base the inventor has used a rod 93 and feet 90 and 92; however, it is known in the art numerous ways to form this base that is of sufficient size and strength to hold the invention. FIG. 1*b* shows that there is an identical base 20 to base 10 at the opposite end of the device. Base 20 is also of sufficient length and width to hold vertical posts 22 and 24 in place and is formed by rod 97 and feet 94 and 96. At the bottom of posts 12, 14, 22 and 24 are adjustable supports 16, 18, 26 and 28. These adjustable supports are designed to attached posts 12, 14, 22 and 26 to bases 10 and 20. The adjustable supports 16, 18, 26, and 28 are adjustable so that the width between posts 12, 14 and 22, 24 can be adjusted. Thus, an individual using the parallel bars can adjust the width between the parallel bars to suite his need and body structure. The adjustable supports 16, 18, 26, and 28 are basically T-shaped with the bottom of the T attached to the posts 12, 14, 22 and 24 and the top of the T in encircling the rods 93 and 97 of the base 10 and 20. The adjustable support solidly holds the posts 12, 14, 22, and 24 in a fix position. To adjust these adjustable supports one moves the supports along the rod 93 or 97 to a point of adjustment. In the portion of the adjustable support that encircles the rod there is a threaded hole. A screw with a knob 122 shown in FIG. 5 and 6 that is adapted to fit within the threaded hole is then threaded into the hole and threaded up against the rods 93 or 97. The screw is screwed in tight enough against the rod that the post will not move and stay in place. Another method for adjusting these posts that is not shown could be by placing a set of openings horizontally along the rod 93 or 97. These openings past through rod 93 or 97. A pin is adapted to fit through each of these openings. In the portion of the T-shape adjustment means that encircles the rod 93 or 97 a pair of openings is placed such that the pin can pass through both openings. Then the post is moved to the adjustment position and the pin is placed through one of the openings in the portion of the adjustment means that encircles the rod then through the opening in the rod and out through the other opening in the portion of the adjustment means that encircles the rod. This will hold the posts 12, 14, 22, or 24 in place.

Figure 2:
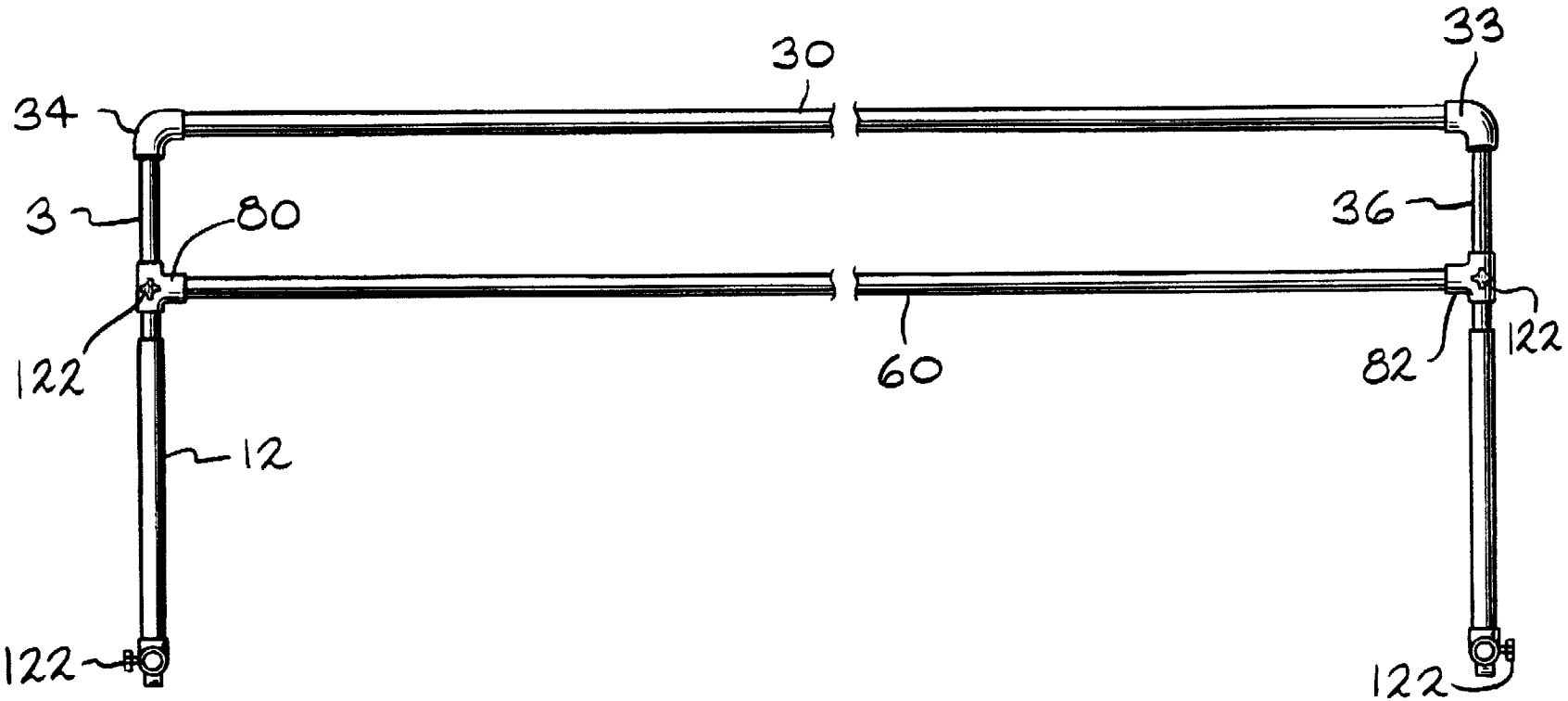
FIG. 2 is a side view of the invention.

In the preferred embodiment posts 12, 14, 22 and 24 are hollow. This enables the top parallel bars 30 and 40 to be placed inside. FIG. 2 gives a good view of top bar 30 of which top bar 40 is identical. Top bar 30 has an elongated top section 32 and an end section 34 and 36 that are bent at right angles along one axis to top section 32. In the preferred embodiment end sections 34 and 36 and top section 30 are attached together with elbows 31 and 33. In the preferred embodiment the end section 34 and 36 also curve inward between one and three inches so that an individual can more easily put his arm over the top bar and grasp a lower bar 60 with his hand. In the preferred embodiment the diameter of the end portions 34 and 36 is smaller than the diameter of posts 12 and 22. The end portions 34 and 36 telescope within post 12 and 22. As I previous stated top bar 40 is identical top bar 30. Top bar 40 has the elongated section 42 and end sections 44 and 46 that are bent at right angles along one axis to elongated section 42. In the preferred embodiment end section 44 and 46 end top section 30 are attached together with elbows 41 and 43. End sections 44 and 46 are also bent inward as end sections 34 and 36. Sections 44 and 46 are of smaller diameter than vertical post 14 and 24 and end portion 44 and 46 telescope into vertical posts 14 and 24.

Figure 4:
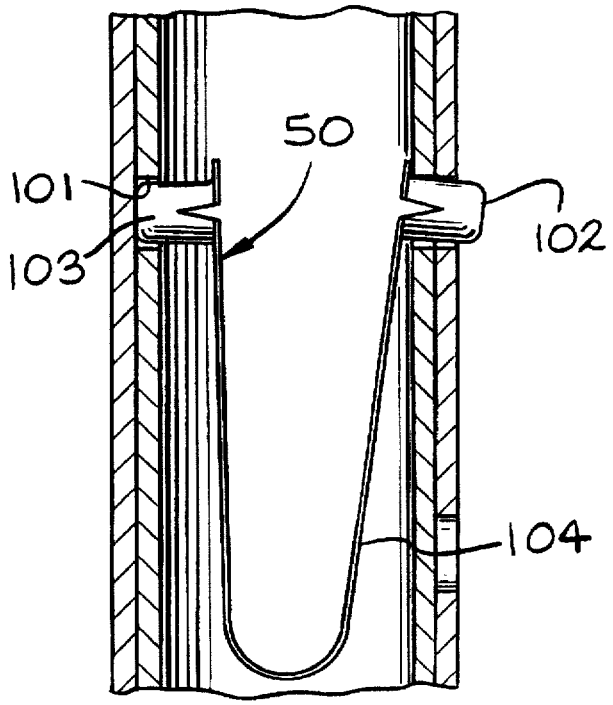
FIG. 4 is a cut away view of the button adjustment system.
Figure 5:
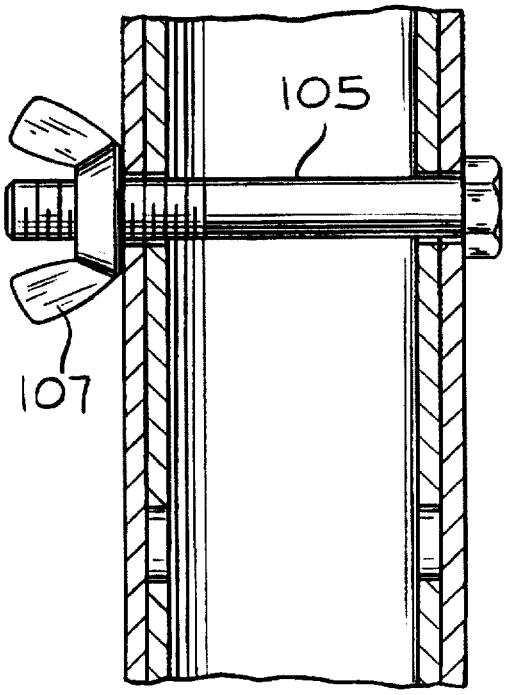
FIG. 5 is a cut away view of the bolt adjustment system.
Figure 6:
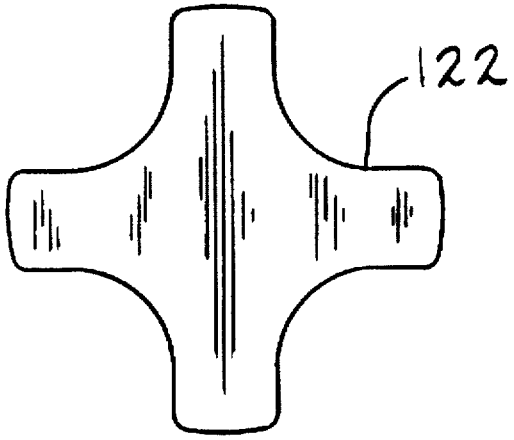
FIG. 6 is the top view of the screw with knob.

The height of the top bar 30 and 40 can be adjusted. On posts 12, 14, 22 and 24 there are a set of openings 100 running vertically. On the end portion 34, 36, 44 and 46 of top bar 30 and 40 there is an opening 101 on each side. In the preferred embodiment a button system 50 fits within end portion 34, 36, 44 and 46 and within the pair of opening 101 as shown by FIG. 4. This button system consist of two caps 102 and 103 on the ends of a v-shaped spring 104. The v-spring 104 is made out of springy material so that when the end caps 102 and 103 are pushed inward and released they will spring to original portion. This button system fits within the set of opening 101 within the end portion 34, 36, 44 and 46 of top bar are 30 and 40. When the end portions 34, 36, 44, and 46 are placed within top parts 12, 14, 22 and 24 one of the caps 102 or 103 fits within one of the holes 101 in the posts. In order to adjust the heights of the top bars 30 and 40 one pushes the cap 102 or 103 a sufficient distance that the top bar can moved up or down in the desired direction. He then moves the top bar to the adjustment hole for the height he wished and the end cap will spring back into that hole and hold the top bar in that position. He does that for both ends of the top bar. FIG. 5 shows another configuration which could be use for adjustment of the top bar. In this configuration the posts 12, 14, 22 and 24 have the set of openings 100 on each side of the posts adapted such that a rod can be placed through the holes. The end portions 34, 36, 40, 44 and 46 of top bar 30 and 40 have a pair of openings in them. In order to adjust the top bar into position one moves the top bar 30 or 40 to the heights that which one wants and lines up set of holes 100 with the opening 101 in the top bar. Then one runs a bolt 105 threaded on one ends through the front hole 100 in the posts 12, 14, 22 or 24. Then through the opening of the end portions of the top bar and out through the hole in the back of the post. Nuts 107 is placed on ends of the bolt 105. In the preferred embodiment a wing nut 107 is used however any type of nut could be used. This then holds the top bar in place at the proper height. Rod 105 is of sufficient strength to hold the top bar into position when the weight of an individual or several individuals would fall on the top bar or use the bar for support.

Another method for adjusting the top bar that is not shown could be placing a threaded hole in the top of the post 12, 14, 22, and 24. Then you adjust the top bar to the height that you wish for your exercise. A screw with a knob such as the one in FIGS. 6 and 7 that is adapted to fit within the threaded hole is then threaded into the hole and threaded up against the end portion of the top bar. The screw is screwed in tight enough against the end portion of the top bar that it will support the top bar. There also are other methods known in the art for adjustment of telescoping posts. These methods could also be easily used for the adjustment of the top bar.

Figure 3:
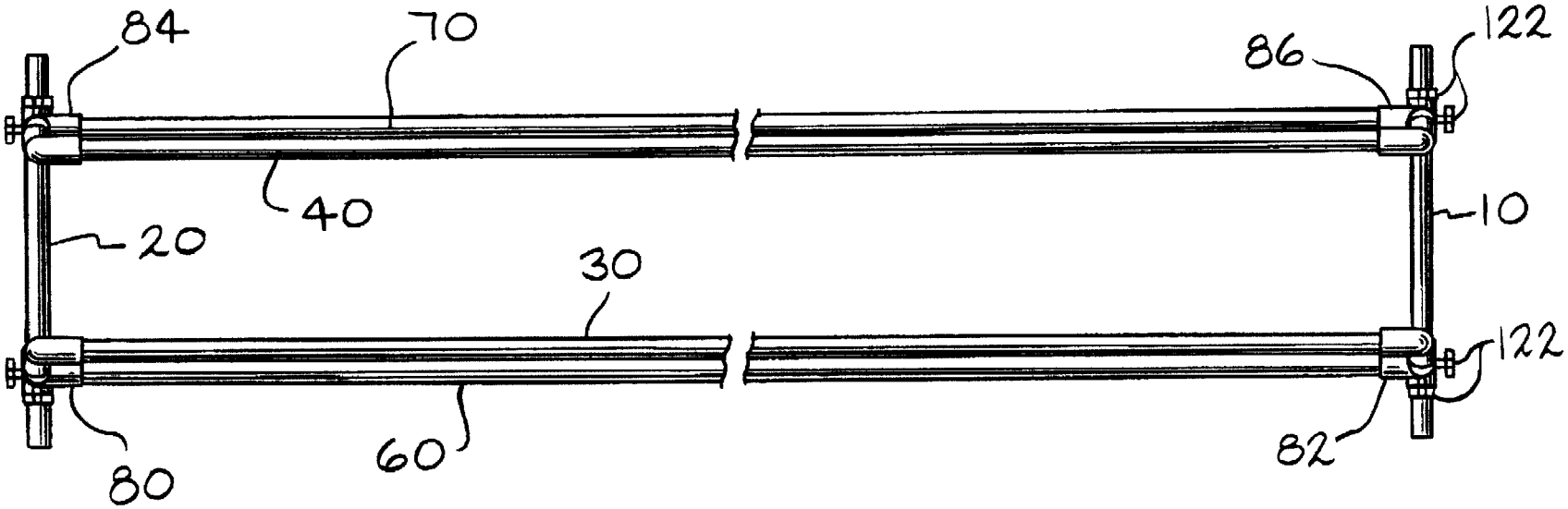
FIG. 3 is a top view of the invention.
Figure 7:
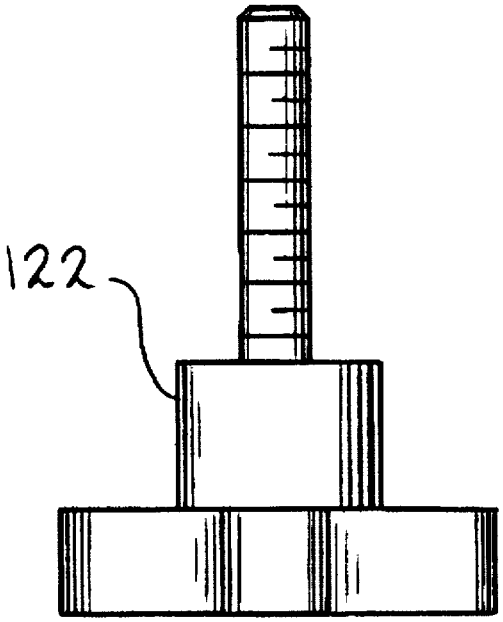
FIG. 7 is the side view screw with knob.

From FIG. 2 we also can see that there is a lower bar 60 attached to posts 12 and 22. FIG. 3 shows that there is a lower bar 70 that is attached to posts 14 and 24 and said lower bar 70 is identical to lower bar 60. Lower bar 60 and 70 are long straight bars that are attached to posts 12, 22, 14 and 24 at their ends. The lower bar 60 is attached to posts 12 and 22 at its ends by attaching means 80 and 82. Lower bar 70 is attached to post 14 and 24 at its ends by attaching means 84 and 86. Attaching means 80, 82, 84 and 86 allow lower bars 60 and 70 to be adjusted as to height. Attachment means 80, 82, 84 and 86 are cylindrical tubes that are attached at right angles to form a T with the lower bars 60 and 70. The cylindrical portion of the attachment means is of sufficient diameter that it can telescopes over 12, 14, 22 and 24. In the side of the cylindrical portion of the adjustment 80, 82, 84 and 86 means is a threaded opening. To adjust the length of the lower bars 60 and 70 one moves the lower bar 60 or 70 along 12 and 14 or 22 and 24 to the height that one wishes for exercise. Then a screw with a knob 122 as in FIG. 7 is threaded in threaded opening in the adjustment 80, 82, 84 and 86 and tighten up against the post 12, 14, 22 and 24. This holds the lower bar 60 or 70 in place. These adjustment means allow an individual to adjust the height of lower bars 60 and 70. Therefore an individual using the parallel bars is able to adjust heights of the bars to fit his body structure and needs.

An individual who is using the bar adjusts the width between the post 12, 14, 24 and 26 so that he can walk between the parallel bars. The individual then adjusts the top bars 30 and 40 to fit underneath his arm pits and then the lower bars 60 and 70 is adjusted so that an individual can hold on to the lower bars 60 and 70 as he walks. Therefore a disable individual using the bars can walk down the bars and if he loses his grip or if his knees buckle or he loses his strength and begins to fall he will be held up by the upper bars 30 and 40 underneath his arm pits similar to crutches. This will enable an individual who does not have sufficient strength to actually walk down the parallel bars to walk without fear of falling and to use the additional crutch of the top bars 30 and 40. It will also add confidence to the individual walking the bar because they do no have to fear falling. The top bars 30 and 40 will also enable nurses, physical therapist or other staff member who overseeing the individuals on the bars to spend less time overseeing the parallel bars since there will be no fear of falling of the patients.

Changes and modifications in the specifically described embodiments can be carried out without departing from the scope of the invention that is intended to be limited only by the scope of the claims.

I claim:

1. A set of parallel bars comprising:

a. two pairs of vertical posts;

b. a means for supporting the vertical posts in a vertical position that sits on the floor and said means for supporting is adapted such that the posts in each pair of vertical posts are a sufficient distance apart that an individual who is using the parallel bars can walk between the posts;

c. a first top bar attached to one of the vertical posts in each of the pairs and said first top bar's height from the floor is approximately the height of an individual's armpit from the floor;

d. a second top bar attached to the other vertical post in each of the pairs of vertical posts and said first and second top bar are parallel to each other and said second top bar is approximately the height of an individual's armpit from the floor;

e. a first bottom bar attached to the same vertical posts as the first top bar and said first bottom bar attaches to said vertical posts below said first top bar and said first bottom bar is a distance below said first top bar that an individual who has placed his arm over said first top bar can grasp said first bottom bar;

f. a second bottom bar attached to the same vertical posts as the second top bar and said second bottom bar attaches to said vertical posts below said top bar such that the two bottom bars are parallel to each other and said second bottom bar is of a distance below said second top bar that an individual whose arm is over said second top bar can easily grasp said second bottom bar;

g. the distance between the first and second top bar is two to six inches or less than the distance between the first and second bottom bars.

2. A set of parallel bars as in claim 1 wherein:

a. the means for supporting comprises two bases and each base supports a pair of vertical posts and the vertical posts in each pair are of a sufficient distance apart that an individual can walk between the posts.

3. A set of parallel bars as in claim 2 further comprising:

a. a first means for adjusting the width between the two posts on one of said bases; and, b. a second means for adjusting the width between the posts on the other base.

4. A set of parallel bars as in claim 1 further comprising:

a. a first means for adjusting the height of the first top bar; and, b. a second means for adjusting the height of the second top bar.

5. A set of parallel bars as in claim 1 further comprising:

a. a first means for adjusting the height of the first bottom bar; and, b. a second means for adjusting the height of the second bottom bar.

6. A set of parallel bars as in claim 1 wherein:

a. the four vertical posts are hollow; and, b. the first and second top bars' end portions are bent at right angles and said top bars' end portions are adapted to telescope within the hollow posts.

7. A set of parallel bars as in claim 6 wherein:

a. the end portions of the first and second top bars are bent inward making the top bars closer together than the first and second bottom bars.

8. A set of parallel bars as in claim 7 further comprising:

a. a first means for adjusting the height of the first top bar; and, b. a second means for adjusting the height of the second top bar.

9. A set of parallel bars as in claim 8 wherein:

a. the first means for adjusting the height of the first top bar comprises:

(1) a set of holes vertically arranged in the vertical posts in each base into which the first top bar telescopes;

(2) a second set of holes that corresponds with the first set of holes in the vertical posts in each base that the top bar telescopes;

(3) an opening in each end portion of the first top bar that passes completely through the first top bar;

(4) rods that are adapted to fit through the holes in the vertical posts and the openings in the top bar;

(5) whereby when an individual adjust the height of the top bar the individual moves the top bar to the desired height and he places a rod through each hole in the vertical posts that corresponds to the openings in the top bar's end portions for the height thus holding the top bar in place.

10. A set of parallel bars as in claim 3 wherein:

a. the base comprises:

(1) a base rod attached to the two post on the base;

(2) feet attached to the base rod;

b. the first means for adjusting comprises:

(1) a tube attached to one of the posts at a right angel and of sufficient diameter that the tube telescopes over the base rod;

(2) a threaded opening in the tube;

(3) a screw with a knob that is adapted to fit within the threaded opening such as when the screw is threaded into the opening it can be tighten against the base rod; and, (4) whereby when an individual adjusts the width between the two posts attached to the base rod the individual moves one of the vertical posts to the desired position along the base rod and then one tightens the screw with the knob against the base rod which holds the post in position.

11. A set of parallel bars as in claim 5 wherein:

a. the first means for adjusting the height of the first bottom bar comprises:

(1) the first bottom bar has two ends;

(2) a tube attached perpendicular to the first bottom bar at one end and said tube is adapted to telescopes over the vertical post;

(3) a second tube perpendicular to the first bottom bar at the other end and said second tube is adapted to telescope over the vertical post;

(4) threaded openings in said tubes;

(5) screws each having a knob adapted to fit within the threaded openings in said tubes and adapted to be tightened against the vertical posts when the tubes telescope over the vertical posts; and, (6) when an individual adjusts the height of the lower bar the individual moves the lower bar to the desired height and tightens the screws against the vertical posts which hold the lower bar in place.

12. A set of parallel bars as in claim 8 wherein:

a. the first means for adjusting the height of the top bar comprises:

(1) a set of holes vertically arranged in the vertical posts of each base into which the first top bar telescopes;

(2) an opening in each end portion of the top bar that passes completely through the top bar;

(3) a V-shape spring with caps on each end that fits into the top bar and said caps are adapted to fit within the opening in the top bar and the holes in the vertical post;

(4) whereby when an individual adjusts the height of the top bar the individual pushes the cap that is protruding through the set of holes in the vertical post a sufficient distance that the top bar can be moved in the desired direction and the individual then moves the top bar to the desired height and the end cap will spring into that hole of the set of holes that corresponds to that height and hold the top bar in position.

* * * * *